US010705550B2

(12) United States Patent
Bhattad et al.

(10) Patent No.: US 10,705,550 B2
(45) Date of Patent: Jul. 7, 2020

(54) MODULAR AND CONFIGURABLE POWER CONVERTER

(71) Applicant: Dialog Semiconductor (UK) Limited, London (GB)

(72) Inventors: Ambreesh Bhattad, Swindon (GB); Frank Kronmueller, Neudenau (DE)

(73) Assignee: Dialog Semiconductor (UK) Limited, London (GB)

( * ) Notice: Subject to any disclaimer, the term of this patent is extended or adjusted under 35 U.S.C. 154(b) by 190 days.

(21) Appl. No.: 16/056,808

(22) Filed: Aug. 7, 2018

(65) Prior Publication Data

US 2019/0041884 A1 Feb. 7, 2019

(30) Foreign Application Priority Data

Aug. 7, 2017 (DE) ..... 10 2017 213 676

(51) Int. Cl.
*G05F 1/563* (2006.01)
*G05F 1/59* (2006.01)
*G05F 1/577* (2006.01)

(52) U.S. Cl.
CPC ..... *G05F 1/563* (2013.01); *G05F 1/577* (2013.01); *G05F 1/59* (2013.01)

(58) Field of Classification Search
CPC ..... G05F 1/563; G05F 1/577; G05F 1/59
See application file for complete search history.

(56) References Cited

U.S. PATENT DOCUMENTS

2006/0170401 A1 8/2006 Chen et al.

FOREIGN PATENT DOCUMENTS

DE 10 2015 218 656 3/2017

OTHER PUBLICATIONS

German Office Action, Reference No. 10 2017 213 676.6, Applicant: Dialog Semiconductor (UK), dated Jul. 5, 2018, 10 pages, and English language translation, 12 pages.

*Primary Examiner* — Robert L Deberadinis
(74) *Attorney, Agent, or Firm* — Saile Ackerman LLC; Stephen B. Ackerman

(57) ABSTRACT

A power converter comprising an error amplifier, a reference current circuit branch and load current circuit branch is presented. The error amplifier is configured to generate an error signal based on a reference value and an output signal at an output of the power converter. The reference current circuit branch comprises a modulation device configured to modulate, based on the error signal, a reference current in the reference current circuit branch. The load current circuit branch comprises a first output transistor configured to adjust, based on the reference current, an output current at the output of the power converter. In addition, the power converter may comprise a slave current circuit branch with a second output transistor configured to adjust, based on the reference current, a slave current in the slave current circuit branch for controlling an external slave power converter.

21 Claims, 8 Drawing Sheets

MODULAR AND CONFIGURABLE POWER CONVERTER

TECHNICAL FIELD

The present document relates to the field of power converters. More specifically, the present document relates to modular and configurable power converters capable of dynamically adjusting their maximum output currents.

BACKGROUND

Typically, a power management integrated circuit PMIC comprises a large number of power converters. These power converters may differ e.g. in terms of power consumption, noise generation, dropout voltages and maximum load currents that they support. However, during the time of designing the PMIC, the specific requirements of the application may not be sufficiently defined and the power converters may not be optimally selected and positioned on the printed circuit board PCB.

For example, a frequently occurring problem is that an output current is needed which exceeds a maximum output current a specific power converter can deliver. In this situation, in order to avoid overloading the specific power converter, one possibility is to connect a second power converter in parallel to provide the required maximum output current. However, when coupling two or more power converters, stability problems may arise. In addition, when coupling two power converters with different gains, only one of both power converters may be effectively regulating whereas the other power converter may be e.g. off by overvoltage or in current limit by under voltage.

SUMMARY

Having the possibility of changing the physical location of a particular output of a particular power converter may be desirable. Moreover, it may be advantageous to have a set of connectable power converters such that e.g. a power converter with a low noise input stage or a power converter with a sufficient maximum output current may be implemented at a particular position on the PCB. These configurable positions and properties of power converters are in particular desirable in the field of application-specific standard products (ASSP) have to be adapted to the peculiarities of the application in a pre-operational phase.

The present document addresses the above mentioned technical problems. In particular, the present document addresses the technical problem of providing a method for dynamically changing locations of the outputs of power converters and for dynamically coupling two or more power converters to obtain a variable maximum output current.

According to an aspect, a power converter comprising an error amplifier, a reference current circuit branch and load current circuit branch is presented. The error amplifier is configured to generate an error signal based on a reference value and an output signal at an output of the power converter. The reference current circuit branch comprises a modulation device configured to modulate, based on the error signal, a reference current in the reference current circuit branch. The load current circuit branch comprises a first output transistor configured to adjust, based on the reference current, an output current at the output of the power converter.

The power converter may be e.g. a voltage regulator for regulating an output voltage at the output of the power converter or a current regulator for regulating an output current at the output of the power converter. For example, the power converter may be a linear regulator configured to maintain a steady output voltage such as e.g. a low-dropout LDO regulator.

The error amplifier may form part of an input stage of the power converter. In particular, the error amplifier may form part of the input stage of a feedback loop for regulating the output signal towards the pre-determined reference value. Depending on the type of power converter used, the error amplifier may generate the error signal based on a reference voltage value and an output voltage at the output of the power converter. Alternatively or additionally, the error amplifier may generate the error signal based on a reference current value and an output current at the output of the power converter. In any case, the error amplifier (or differential amplifier) may be configured to determine a difference signal based on the reference value and the output signal, and to generate the error signal as an amplified version of said difference signal. For this purpose, any suitable type of circuit comprising an operational amplifier may be used. For example, the error amplifier may be of an N-type metal-oxide semiconductor MOS, a P-type MOS, or a bipolar junction transistor BJT input differential pair. Specifically, the error amplifier may comprise e.g. a voltage controlled current source VCCS with an appropriately chosen transconductance $G_m$.

Both the reference current circuit branch and the load current circuit branch may form part of an output stage of the described power converter. For instance, the reference current circuit branch and the load current circuit branch may form parallel electrical paths between a supply voltage and ground. Throughout this document, the term "ground" is meant in its broadest possible sense. In particular, ground is not limited to a reference point with a direct physical connection to earth. Rather, the term "ground" may refer to any reference point to which and from which electrical currents may flow or from which voltages may be measured.

The modulation device may be e.g. any type of field effect transistor FET or BJT.

Similarly, the first output capacitor (also denoted as pass device) may be any type of FET or BJT. Preferably, the first output transistor is configured to adjust the output current such that the output current is an amplified version of the reference current. This may be achieved by (a) providing a reference transistor in series with the modulation device in the reference current circuit branch between the supply voltage and ground, and (b) by connecting the reference transistor and the first output transistor such that both transistors form a first current mirror. To this end, the reference transistor may be a diode-connected transistor and a gate terminal of the reference transistor and a gate terminal of the first output transistor may be biased at the same voltage level. In addition, both the reference transistor and the first output transistor may be of the same type, e.g. of the p-channel MOSFET type.

The above-described structure of the power converter makes it possible to couple two or more power converters on an electronic device in a stable and efficient manner. The idea is to provide a modular concept with identically or at least similarly structured power converters with the above-described components. These power converters may be dynamically (re-)configured to fulfill the requirements of the application. Further, the idea is to configure one power converter acting as a master power converter and configure another power converter acting as a slave power converter using a dedicated configuration unit with a switching matrix.

The switching matrix may be configured to connect a gate terminal of the first output transistor of the master power converter with a gate terminal of the first output transistor of the slave power converter. The switching matrix may be configured to connect an output of the error amplifier of the master power converter with an input of the modulation device of the master power converter. At the same time, the switching matrix may be configured to disable the modulation device of the slave power converter. Disabling the modulation device may be achieved e.g. by connecting a gate terminal of a transistor implementing the modulation device with ground. Hence, it becomes possible to connect both outputs of the master power converter and the slave power converter together and to draw an increased maximum output current from the connected outputs while at the same time avoiding stability problems.

In the following description, it is assumed that—without loss of generality—only two power converters are coupled together. However, it is appreciated that the master power converter may be connected to an arbitrary number of slave power converters.

Moreover, the power converter may further comprise a slave current circuit branch with a second output transistor configured to adjust, based on the reference current, a slave current in the slave current circuit branch for controlling an external slave power converter. Still, the reference transistor and the first output transistor may be configured to form the first current mirror. Additionally, the reference transistor and the second output transistor may be connected to form a second current mirror. Again, the reference transistor may be a diode-connected transistor. The gate terminal of the reference transistor, the gate terminal of the first output transistor, and a gate terminal of the second output transistor may be biased at the same voltage level. The reference transistor, the first output transistor and the second output transistor may be of the same type, e.g. of the p-channel MOSFET type.

The slave current circuit branch serves as an additional structure within the power converter to branch off a current (i.e. the slave current) which has a well-known relationship to the actual output current of the power converter. In fact, the ratio of the slave current to the output current may be determined based on the characteristics (such as e.g. the resistance values at the respective operating points) of the first current mirror and the second current mirror. The generated slave current may be advantageously used to control operation of the external slave power converter.

The reference current circuit branch may comprise a master current injection branch for injecting a master current from an external master power converter, wherein the master current injection branch is arranged in parallel to the modulation device. For example, the master current injection branch may extend between ground and a node on the reference current circuit branch located between the modulation device and the reference transistor. The master current injection branch may comprise a third current mirror with an injection transistor and a mirror transistor, wherein the mirror transistor is connected in parallel to the modulation device. The injection transistor may be a diode-connected transistor for injecting the master current. The injection transistor and the mirror transistor may be of the same type, e.g. of the n-channel MOSFET type. For example, the master current may be injected into the drain terminal or the source terminal of the injection transistor in case the latter is implemented using MOSFET technology. At this, the person skilled in the art understands that the master current may not be directly injected into the drain terminal or the source terminal, but may as well be injected into any conducting structures electrically coupled to the drain terminal or to the source terminal.

The master current injection branch serves as an additional structure within the power converter to couple in a current (i.e. the master current) for controlling the power converter from the external master power converter. The master current injection branch in parallel to the modulation device enables substituting the reference current by the master current in case the modulation device is disabled. In other words, as will be described in detail below, a configuration unit may decide that a specific power converter is supposed to act as slave power converter and a switching matrix of this configuration unit may interrupt the propagation of the error signal between the error amplifier and the modulation device of the specific power converter. In the described situation, the switching matrix is configured to establish an electrical connection between a master power converter and the master current injection branch of the power converter such that the injected master current replaces a reference current which would be adjusted by the modulation device during normal operation of the power converter (i.e. when the power converter is not elected to behave as a slave power converter).

The power converter may further comprise an output capacitor coupled between the output of the power converter and ground.

According to another aspect, an electronic device comprising two of the above-described power converters is presented. One of the two power converters is denoted a master power converter, whereas the other power converter is denoted as slave power converter. The reference value applied to the error amplifier of the master power converter may be identical to or different from the reference value applied to the error amplifier of the slave power converter. The electronic device comprises a configuration unit with a switching matrix configured to connect the slave current circuit branch of the master power converter with the master current injection branch of the slave power converter such that the slave current of the master power converter is injected as the master current into the slave power converter.

The switching matrix may be configured to connect an output of the error amplifier of the master power converter with an input of the modulation device of the master power converter, or to connect an output of the error amplifier of the slave power converter with the latter input. On the other hand, the switching matrix may be configured to disconnect the output of the error amplifier of the master power converter from the input of the modulation device of the master power converter, or to disconnect the output of the error amplifier of the slave power converter from the latter input. For example, the switching matrix may be configured to disable the modulation device of the slave power converter (e.g. by connecting the gate terminal of the modulation device to ground) when the output of the error amplifier of the master power converter is connected with the input of the modulation device of the master power converter. Or, the switching matrix may be configured to disable the modulation device of the master power converter e.g. by connecting the gate terminal of the modulation device to ground) if needed.

Moreover, the switching matrix may be configured to disable the master current injection branch of the master power converter (e.g. by connecting a drain terminal or a source terminal of the injection transistor with ground) when the output of the error amplifier of the master power converter is connected with the input of the modulation device of the master power converter. The configuration unit may further comprise one or more registers for programming the switching behavior of the switching matrix and/or for storing the reference values of the error amplifiers.

The electronic device may be e.g. a power management integrated circuit PMIC. More specifically, the electronic device may be an application-specific standard product e.g. where the final application of a complex PMIC is not defined at design time. Those skilled in the art will appreciate that the electronic device may comprise a plurality of power converters comprising respective input stages and output stages. On the one hand, the input stages may comprise respective error amplifiers. On the other hand, the output stages may comprise respective modulation devices and the above-described circuit branches for amplifying reference currents, extracting slave currents and injecting master currents. Hence, the described electronic device enables a dynamic selection of one input stage and connection of the selected input stage with a selected output stage. A user of the electronic device may select the input stage according to the requirements of the application. Further, the user may select an output stage e.g. based on the location of an output terminal the output stage. With the help of the switching matrix, an arbitrary number of output stages may be coupled to this output stage to increase the maximum output current of the combined power converter.

At the same time, a uniform current distribution between output stages may be achieved by dimensioning the output stages accordingly. Particularly, situations are avoided in which only one power converter of two or more coupled power converters carries the entire output current.

According to yet another aspect, a method of operating a power converter is presented. The method comprises generating, by an error amplifier, an error signal based on a reference value and an output signal at an output of the power converter. The method further comprises modulating, by a modulation device, based on the error signal, a reference current in a reference current circuit branch of the power converter. A first output transistor adjusts, based on the reference current, an output current at the output of the power converter. The method may further comprise adjusting, by a second output transistor, based on the reference current, a slave current in a slave current circuit branch for controlling an external slave power converter. Further, the slave current may be injected into the external slave power converter. In particular, the method may further comprise providing a reference transistor in series with the modulation device within the reference current circuit branch, configuring the reference transistor and the first output transistor such that the reference transistor and the first output transistor form a first current mirror; and configuring the reference transistor and the second output transistor such that the reference transistor and the second output transistor form a second current mirror.

In addition, the method may comprise providing within the reference current circuit branch a master current injection branch such that the master current injection branch is arranged in parallel to the modulation device; and injecting a master current from an external master power converter into the master current injection branch.

According to yet another aspect, a method of coupling a master power converter as described in the foregoing description with a slave power converter as described in the foregoing description is presented. The method comprises connecting, using a switching matrix, the slave current circuit branch of the master power converter with the master current injection branch of the slave power converter such that the slave current of the master power converter is injected as the master current into the slave power converter. The method may comprise connecting, using the switching matrix, an output of the error amplifier of the master power converter with an input of the modulation device of the master power converter. Alternatively or additionally, the method may comprise connecting, using the switching matrix, the output of the error amplifier of the slave power converter with the latter input.

According to yet another aspect, a method of coupling a master power converter as described in the foregoing description with a slave power converter as described in the foregoing description is presented. The method comprises connecting, using a switching matrix, a gate terminal of the first output transistor of the master power converter with a gate terminal of the first output transistor of the slave power converter.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple", "connect", "coupled" or "connected" refers to elements being in electrical communication with each other, whether directly connected e.g., via wires, or in some other manner.

BRIEF DESCRIPTION OF THE DRAWINGS

The disclosure is explained below in an exemplary manner with reference to the accompanying drawings, wherein.

DETAILED DESCRIPTION

Figure 1:
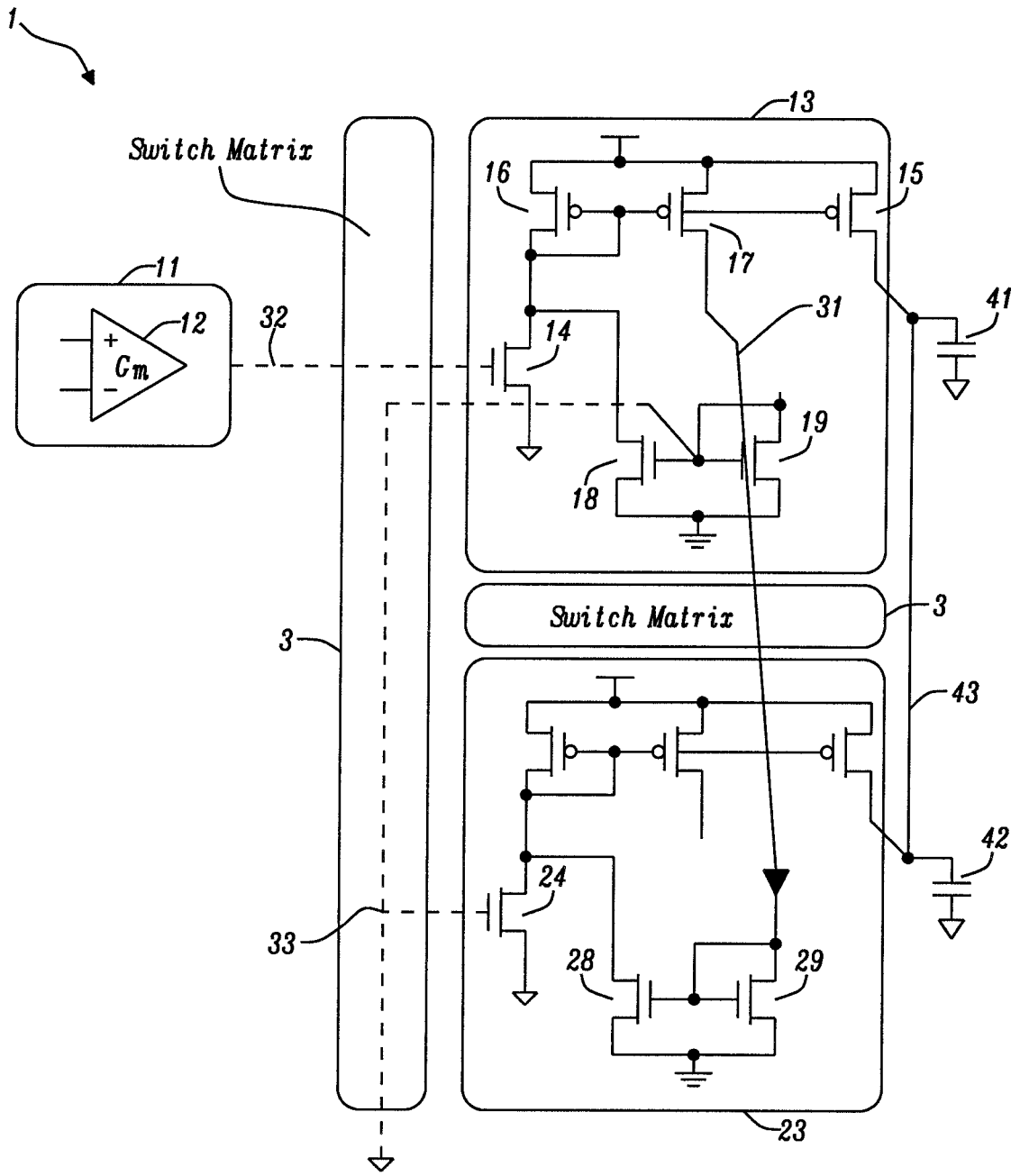
FIG. 1 shows an electronic device with coupled power converters.

FIG. 1 shows an exemplary electronic device 1 for illustrating aspects of the present disclosure. The electronic device 1 comprises a first power converter comprising an input stage 11 and an output stage 13. Input stage 11 comprises an error amplifier 12 configured to generate an error signal based on a reference voltage and an output voltage at an output of the first power converter. The output stage 13 comprises a reference current circuit branch with a modulation device 14 configured to modulate, based on the error signal, a reference current in the reference current circuit branch. Further, the output stage 13 comprises a load current circuit branch comprising a first output transistor 15 configured to adjust, based on the reference current, an output current at the output of the power converter. FIG. 1 also illustrates a slave current circuit branch with a second output transistor 17 configured to adjust, based on the reference current, a slave current in the slave current circuit branch for controlling an external slave power converter. The reference current circuit branch comprises a reference transistor 16, and wherein the modulation device 14 and the reference transistor 16 are arranged in series in the reference current circuit branch between a supply voltage and ground. Since in the depicted example the gates of all transistors are connected, all sources are connected to ground and the drain of the reference transistor is connected with its gate, the reference current is mirrored to both the output current circuit branch and the slave current circuit branch. At this, the respective mirror ratios depends on e.g. the dimensioning of the used transistors.

In the depicted example device 1, the first power converter is elected as master power converter. Consequently, a switching matrix 3 establishes an electrical connection 32 between input stage 11 and the output stage 13 of the first power converter. FIG. 1 also shows the output stage 23 of a second power converter which is—in the illustrated example—identical to the first power converter. As the second power converter is elected as slave power converter for coupling with the first power converter, its input stage is not needed and also not depicted in FIG. 1. FIG. 1 only depicts the output stage 23 of the second, slave power converter. Switching matrix 3 is establishing an electrical connection 33 between ground and the gate of the modulation device 24 of the second power converter to disable the modulation device 24.

The reference current circuit branch of the second power converter further comprises a master current injection branch for injecting a master current from e.g. the first power converter. As illustrated in FIG. 1, the master current injection branch comprises a further current mirror with an injection transistor 29 and a mirror transistor 28, wherein the mirror transistor 28 is connected in parallel to the (here disabled) modulation device 24. The switching matrix 3 now connects the slave current circuit branch of the master (top) power converter with the master current injection branch of the slave (bottom) power converter via the electrical connection 31 such that the slave current of the master power converter is injected as the master current into the slave power converter. As a consequence, the slave current of the master power converter is used to drive and control the output stage 23 of the slave power converter in a stable and efficient manner. The outputs of both output stages 13, 23 may now be externally connected via link 43, thereby providing a single output of the electronic device 1 for supporting an increased amount of output current.

It should be noted that at the outputs of both output stages 13, 23, respective output capacitors 41, 42 are connected which may have preferably the same or similar capacitances. If then outputs of the output stages are connected to an external load, the capacitances of the output capacitors 41, 42 add up, providing an almost constant bandwidth behavior.

Finally, it should be noted that the switching matrix 3 may be configured to disable the master current injection branch of the master power converter because it is not needed in the depicted scenario. This may be done e.g. by grounding the gate of the mirror transistor 18 and/or the gate of the injection transistor 19 via electrical connection 33.

Figure 2:
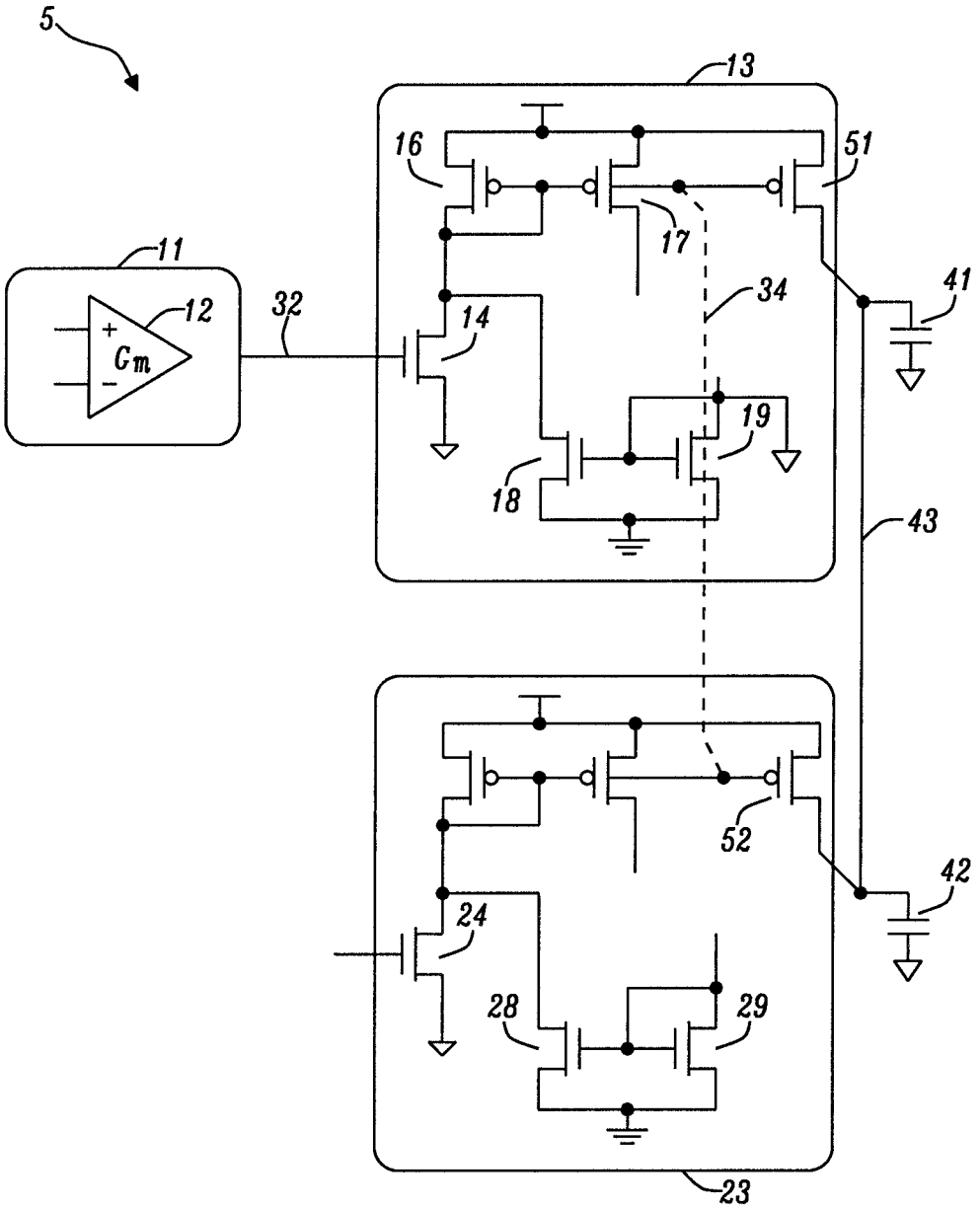
FIG. 2 shows another electronic device with coupled power converters.

FIG. 2 shows another electronic device 5 which illustrates aspects of the present disclosure. Electronic device 5 comprises two power converters which are identical to the power converters discussed in the context of FIG. 1. In electronic device 5, the switching matrix 3 (not shown) connects the gate terminal of the first output transistor 51 of the master power converter via electrical connection 34 with the gate terminal of the first output transistor 52 of the slave power converter. In comparison to the link configuration presented in FIG. 1 where the slave current is branched off and routed via the switching matrix 3 to the bottom output stage, the electrical connection 34 may cause injections problems since a signal node needs to be directed through the switching matrix 3. Thus, the electrical connection 31 in FIG. 1 may still be a preferred solution for combining two or more output stages.

Figure 3:
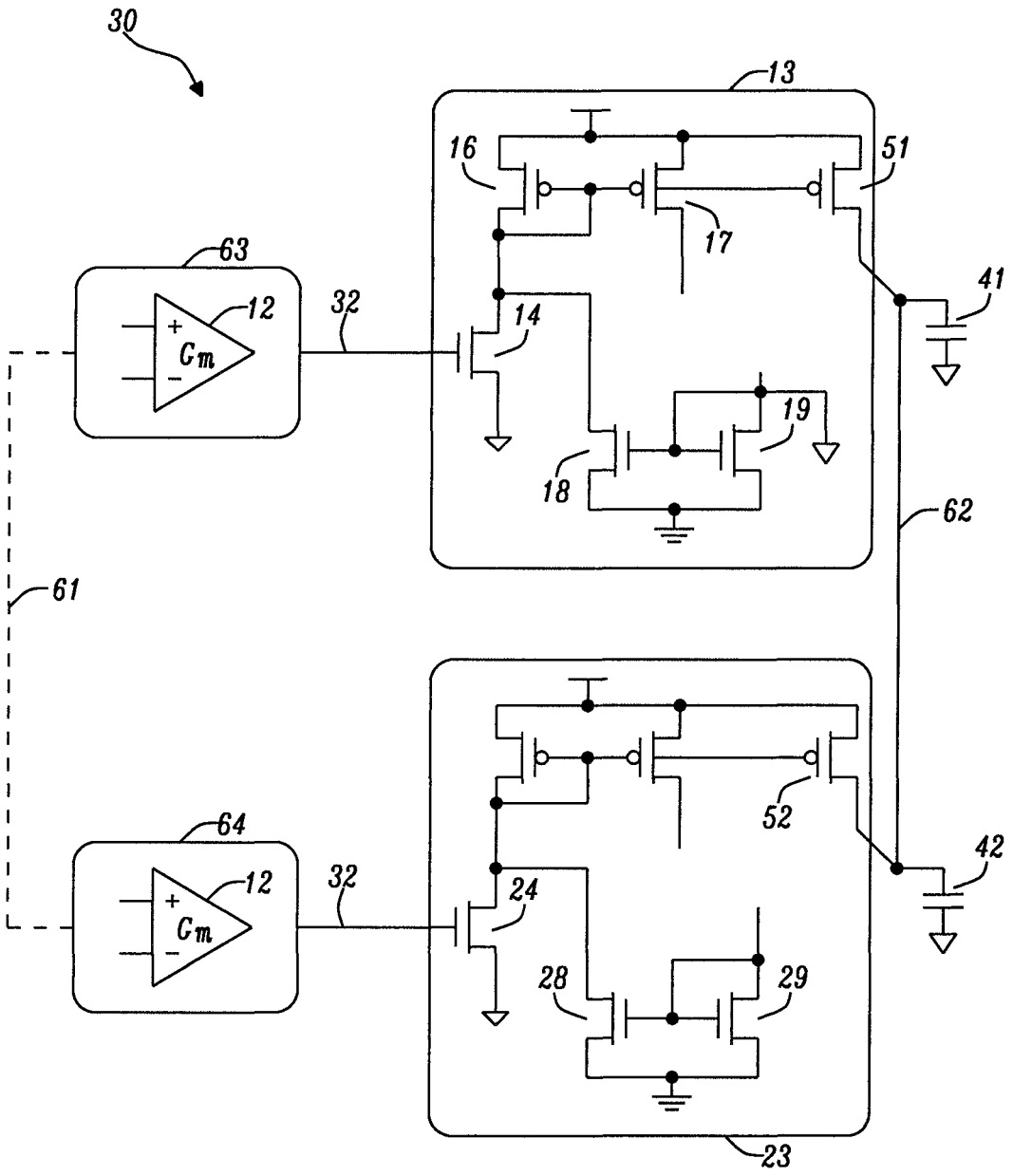
FIG. 3 shows a third coupling of two power converters.

FIG. 3 shows 30, a third potential coupling between two output stages of two power converters, which is regarded as inferior compared to the solutions depicted in FIGS. 1 and 2. In the exemplary scenario depicted in FIG. 3, the input stages 63, 64 of both power converters are directly connected via link 61 and the joint output current is drawn from the outputs of both power converters, which are coupled via output link 62. This brute force parallelization approach may show the disadvantage that only the stronger power converter, i.e. the power converter with the higher gain, may be actively regulating, and the weaker power converter may be turned off.

Figure 4:
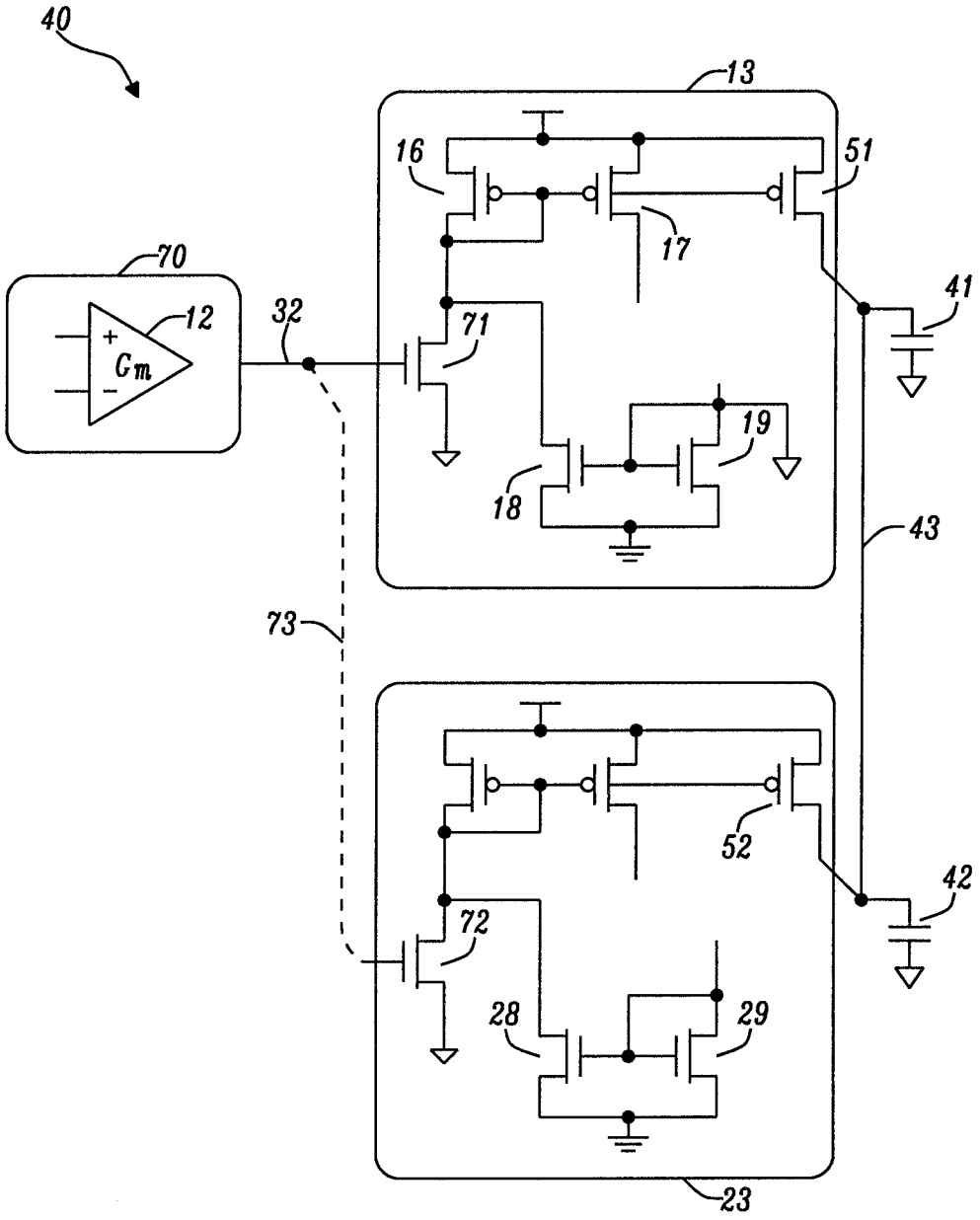
FIG. 4 shows a fourth coupling of two power converters.
Figure 5:
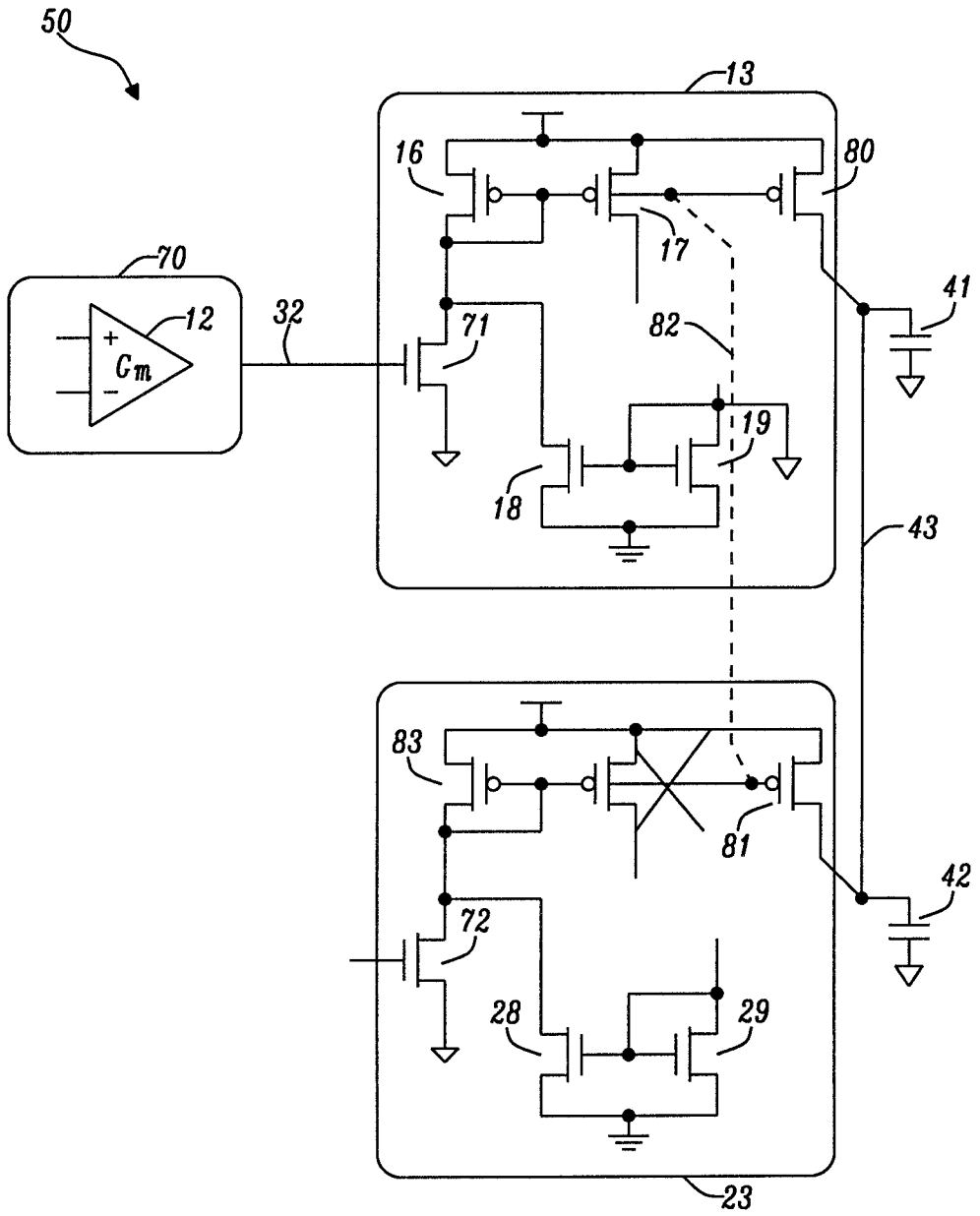
FIG. 5 shows a fifth coupling of two power converters.

FIGS. 4 and 5 show 40 and 50, respectively, alternative coupling of two power converters which may result in severe stability problems. In FIG. 4, the error signal generated by the input stage 70 of the master power converter is applied to both modulation devices 71, 72 via the link 73 provided by switching matrix 3 (not shown). The input stage of the slave converter is by-passed in the example of FIG. 4. However, the gate terminal of the modulation device 71 constitutes a sensitive gain node which may not be a preferred solution. Moreover, the critical bandwidth of an inner gain stage may be reduced when two or more output stages are paralleled in this manner. Similarly, in FIG. 5, tapping the gate terminal of the pass device (first output transistor) 80 and connecting this terminal via link 82 with the gate terminal of the pass device 81 of the slave power converter will result in deteriorated frequency behavior if pass device 81 is not configured to mirror the reference current within the reference current circuit branch. In FIG. 5, the missing electrical connection between the gates of reference transistor 83 and the pass device 81 is emphasized using a cross.

Figure 6:
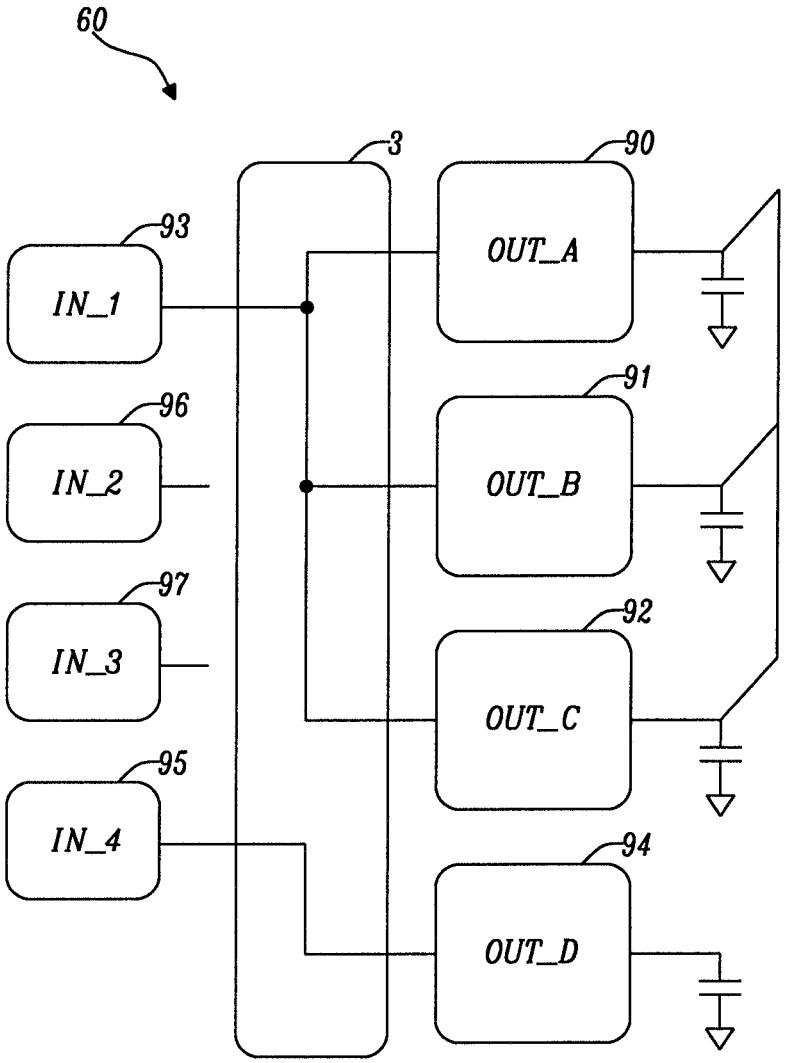
FIG. 6 shows a possible coupling of more than two output stages.

FIG. 6 shows 60, a possible coupling of three output stages 90, 91, 92 to a single input stage 93. Output stage 94 is coupled to input stage 95, and input stages 96, 97 remain disconnected. According to the principles outlined in the present disclosure, it becomes possible to have a plurality of input stages and output stages on a chip which can be linked with maximum flexibility to form power converters with the desired properties at the desired locations. Further, the proposed methodology enables the provision of a variable maximum output current or a minimum dropout voltage for a given application using unit output stages. Preferably, there is only one input stage active to control a set of output stages.

Figure 7A:
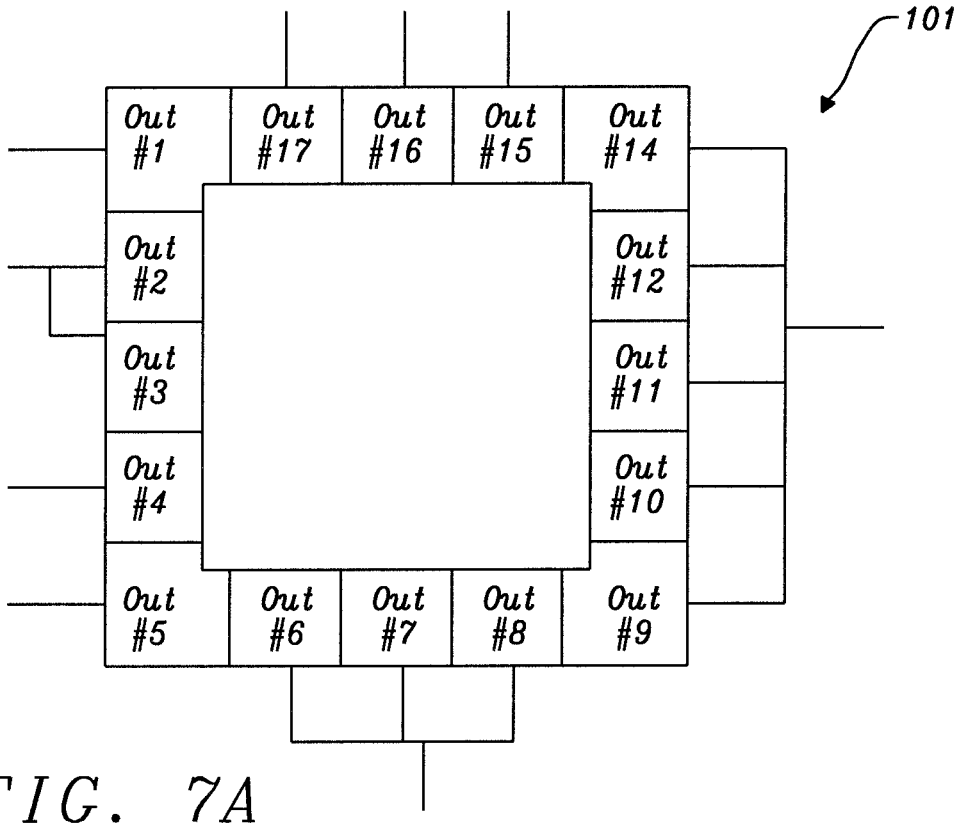
FIGS. 7A & 7B illustrate two possible configurations of connected output stages.
Figure 7B:
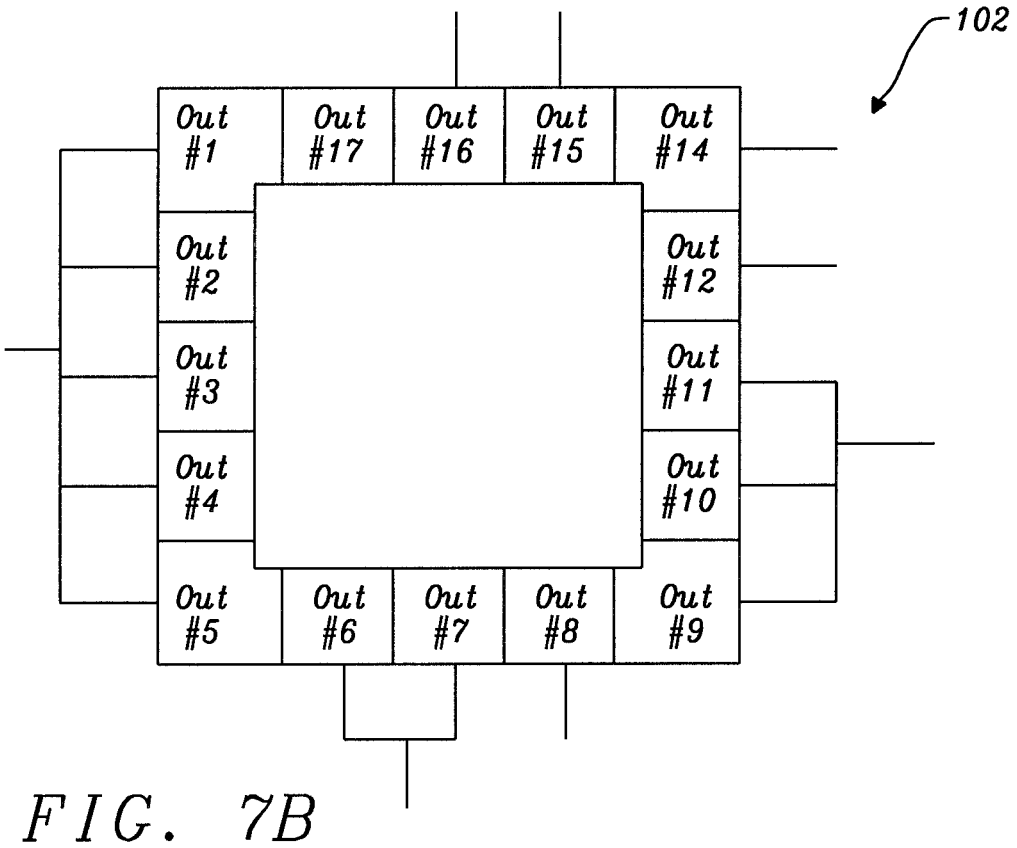

This is also illustrated in FIGS. 7A & 7B, where two possible configurations 101 & 102 of connected output stages are depicted.

Figure 8:
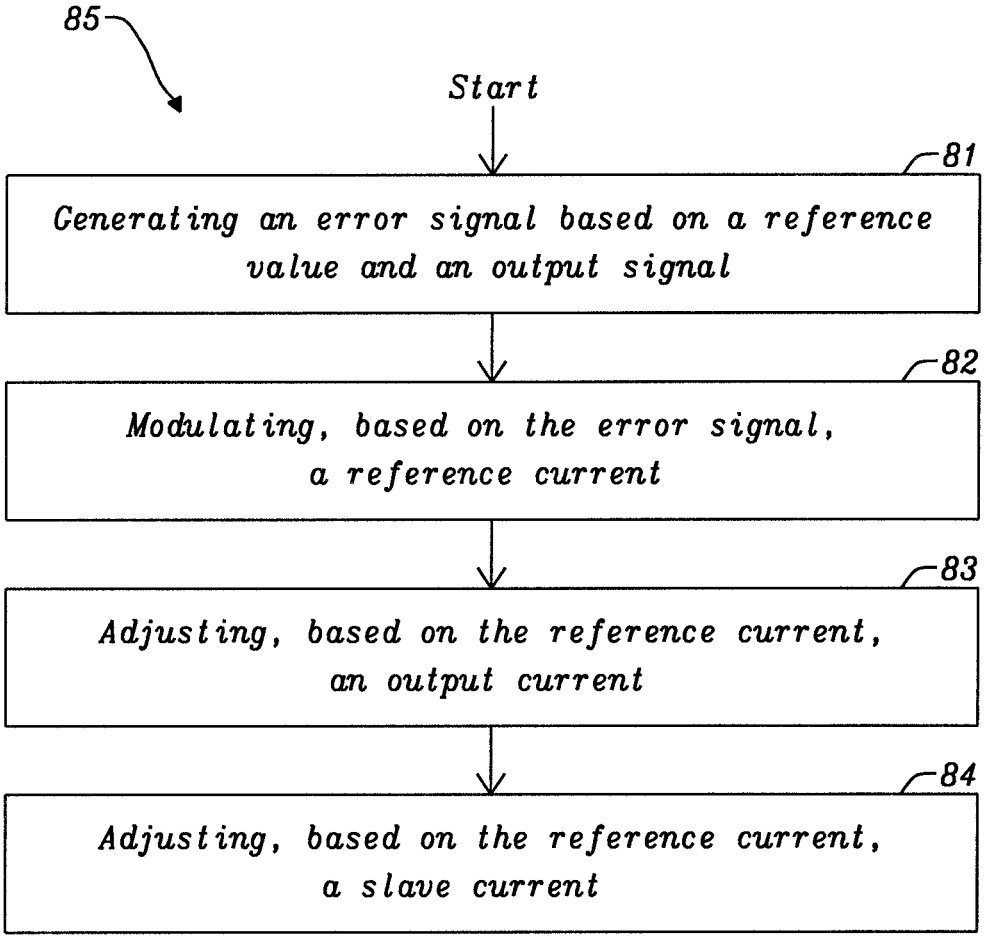
FIG. 8 is a flow chart of a method for a modular and configurable power converter.

FIG. 8 is a flow chart of method 85, for a modular and configurable power converter. The method includes step 81, generating an error signal based on a reference value and an output signal. The method also includes step 82, modulating, based on the error signal, a reference current. The method also includes step 83, adjusting, based on the reference current, an output current. The method also includes step 84, adjusting, based on the reference current, a slave current.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A power converter comprising an error amplifier configured to generate an error signal based on a reference value and an output signal at an output of the power converter;

a reference current circuit branch comprising a modulation device configured to modulate, based on the error signal, a reference current in the reference current circuit branch; and a load current circuit branch comprising a first output transistor configured to adjust, based on the reference current, an output current at the output of the power converter.

2. The power converter of claim 1, further comprising a slave current circuit branch with a second output transistor configured to adjust, based on the reference current, a slave current in the slave current circuit branch for controlling an external slave power converter.

3. The power converter of claim 1, wherein the reference current circuit branch further comprises a reference transistor, and wherein the modulation device and the reference transistor are arranged in series in the reference current circuit branch between a supply voltage and ground.

4. The power converter of claim 3, wherein the reference transistor and the first output transistor are connected to form a first current mirror, and wherein the reference transistor and the second output transistor are connected to form a second current mirror.

5. The power converter of claim 3, wherein the reference transistor is a diode-connected transistor and a gate terminal of the reference transistor, a gate terminal of the first output transistor, and a gate terminal of the second output transistor are biased at the same voltage level.

6. The power converter of claim 1, wherein the reference current circuit branch further comprises a master current injection branch for injecting a master current from an external master power converter, the master current injection branch arranged in parallel to the modulation device.

7. The power converter of claim 6, wherein the master current injection branch comprises a third current mirror with an injection transistor and a mirror transistor, the mirror transistor connected in parallel to the modulation device.

8. The power converter of claim 7, wherein the injection transistor is a diode-connected transistor for injecting a master current.

9. The power converter of claim 1, further comprising an output capacitor coupled between the output of the power converter and ground.

10. An electronic device comprising:

a master power converter;

a slave power converter; and a configuration unit comprising a switching matrix configured to connect the slave current circuit branch of the master power converter with the master current injection branch of the slave power converter such that the slave current of the master power converter is injected as the master current into the slave power converter.

11. The electronic device of claim 10, wherein the switching matrix is configured to connect an output of the error amplifier of the master power converter with an input of the modulation device of the master power converter, or to connect an output of the error amplifier of the slave power converter with the input of the modulation device of the master power converter.

12. The electronic device of claim 10, wherein the switching matrix is configured to disable the modulation device of the slave power converter when the output of the error amplifier of the master power converter is connected with the input of the modulation device of the master power converter.

13. The electronic device of claim 10, wherein the switching matrix is configured to disable the master current injection branch of the master power converter when the output of the error amplifier of the master power converter is connected with the input of the modulation device of the master power converter.

14. An electronic device comprising a master power converter;

a slave power converter; and a configuration unit comprising a switching matrix configured to connect a gate terminal of the first output transistor of the master power converter with a gate terminal of the first output transistor of the slave power converter.

15. A method of operating a power converter, the method comprising:

generating, by an error amplifier, an error signal based on a reference value and an output signal at an output of the power converter;

modulating, by a modulation device, based on the error signal, a reference current in a reference current circuit branch of the power converter; and adjusting, by a first output transistor, based on the reference current, an output current at the output of the power converter.

16. The method of claim 15, further comprising:

adjusting, by a second output transistor, based on the reference current, a slave current in a slave current circuit branch for controlling an external slave power converter; and injecting the slave current into the external slave power converter.

17. The method of claim 15, further comprising:

providing a reference transistor in series with the modulation device within the reference current circuit branch;

configuring the reference transistor and the first output transistor such that the reference transistor and the first output transistor form a first current mirror; and configuring the reference transistor and the second output transistor such that the reference transistor and the second output transistor form a second current mirror.

18. The method of claim 15, further comprising:

providing within the reference current circuit branch a master current injection branch such that the master current injection branch is arranged in parallel to the modulation device; and injecting a master current from an external master power converter into the master current injection branch.

19. A method of coupling a master power converter, with a slave power converter, the method comprising:

connecting, using a switching matrix, the slave current circuit branch of the master power converter with the master current injection branch of the slave power converter such that the slave current of the master power converter is injected as the master current into the slave power converter.

20. The method of claim 19, further comprising:

connecting, using the switching matrix, an output of the error amplifier of the master power converter with an input of the modulation device of the master power converter; or connecting, using the switching matrix, the output of the error amplifier of the slave power converter with the input of the modulation device of the master power converter.

21. A method of coupling a master power converter with a slave power converter, the method comprising:

connecting, using a switching matrix, a gate terminal of the first output transistor of the master power converter with a gate terminal of the first output transistor of the slave power converter.

* * * * *